United States Patent [19]

McMillan et al.

[11] Patent Number: 4,639,710

[45] Date of Patent: Jan. 27, 1987

[54] FOOT PEDAL FOR VARYING RESISTANCE IN AN ELECTRICAL CIRCUIT

[76] Inventors: Thomas A. McMillan, 101 Dory Rd., N. Palm Beach, Fla. 33408; Henry W. Mitchell, 9744 Dogwood Ave., Palm Beach Gardens, Fla. 33410; Alvin S. Cecil, 6042 Rogers St., Lake Park, Fla. 33310

[21] Appl. No.: 822,219

[22] Filed: Jan. 24, 1986

[51] Int. Cl.[4] ..... H01H 3/14; H01C 10/10

[52] U.S. Cl. ..... 338/108; 200/86.5; 338/110

[58] Field of Search ..... 200/86.5, 153 T, 153 C; 338/99, 100, 101, 108, 110, 114, 115, 116, 198, 200

[56] References Cited

U.S. PATENT DOCUMENTS

| | | | |
|---|---|---|---|
| Re. 28,595 | 10/1975 | DuRocher | 338/114 |
| 2,305,717 | 12/1942 | La Bell | 338/114 |
| 2,445,660 | 7/1948 | Bruestle | 338/114 |
| 2,843,710 | 7/1958 | Happe | 338/110 |
| 2,951,817 | 9/1960 | Myers | 338/114 |
| 4,163,204 | 7/1979 | Sado | 338/114 |
| 4,172,217 | 10/1979 | Miller | 200/86.5 |

*Primary Examiner*—G. P. Tolin

*Attorney, Agent, or Firm*—Jack N. McCarthy

[57] ABSTRACT

A foot pedal for varying resistance in an electrical circuit having an on-off control is formed having a base member with an actuator foot plate cover pivotally mounted thereto; an array of circular members is positioned in a circular recess between said base member and cover; said array including a pair of electrode discs spaced by a compressible resistance disc; said compressible resistance disc comprising a flexible elastomer with electro-conductive particulate dispersed therein; said array including an actuating plate which has a spherical joint connection with the actuator foot plate cover; an operator's foot pressure compresses the compressible disc to decrease resistance while a spring opens the pedal device when the operator's foot pressure is removed.

5 Claims, 6 Drawing Figures

FOOT PEDAL FOR VARYING RESISTANCE IN AN ELECTRICAL CIRCUIT

TECHNICAL FIELD

This invention relates to foot, or treadle, switches or devices for varying the resistance in an electrical circuit to control an electrical device such as a motor by acting on a compressible element having electrically conductive particles dispersed therethrough.

BACKGROUND ART

Most variable resistance controls comprise a potentiometer which is well known in the art. Patents showing a compressible element for varying resistance are the following: U.S. Pat. Nos. Re. 28,595; 1,335,016; 1,335,019; 2,305,717; 2,375,178; 2,445,660; 2,951,817; and 4,163,204.

DISCLOSURE OF INVENTION

It is an object of this invention to provide a foot pedal device having a small degree of angular movement which will provide a variable resistance for an electric control and also an on-off action.

Another object of this invention is to provide a foot pedal device having an array of circular members for providing the variable resistance; a circular pressure sensitive resistor element composed of a flexible elastomer with an electro-conductive particulate dispersed therein is positioned between two circular electrode plates which are each in turn connected by wires to an exterior control box; an actuating plate moved by an operator's foot places pressure on the pressure sensitive element through the circular electrodes, and a spring force opens the pedal device as the operator's foot is removed from the foot pedal device, removing the pressure.

It is a further object of this invention to provide a foot pedal device having a small degree of angular movement where the array of circular members, including electrode discs and a compressible resistance disc, are provided with an actuating plate having a spherical or universal joint connection with the movable portion of the foot pedal device so that an even pressure is placed over the electrically active electrode discs and compressible resistance disc.

BEST MODE FOR CARRYING OUT THE INVENTION

Figure 1:
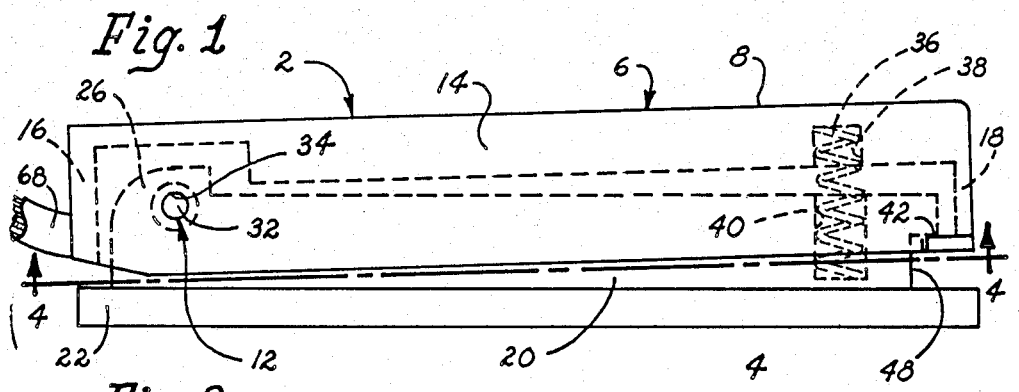
FIG. 1 is a side view of the foot pedal device.
Figure 2:
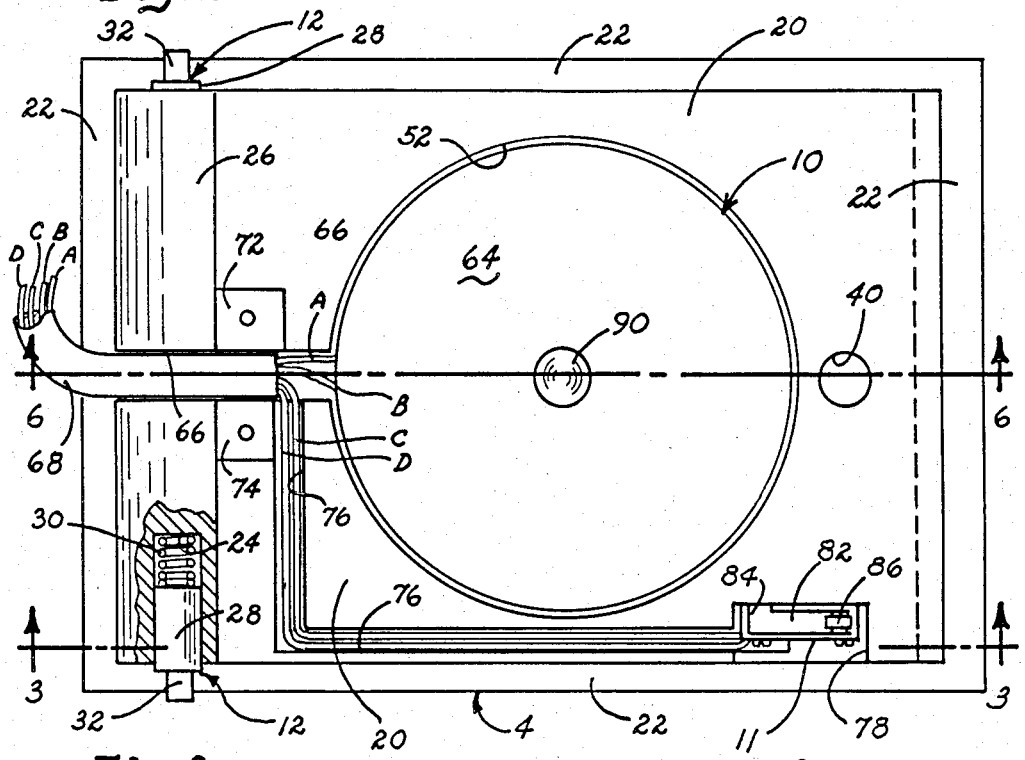
FIG. 2 is a top view of the foot pedal device with the actuator foot plate cover removed, showing the base member with the circular actuating plate set therein and the on-off microswitch.
Figure 3:
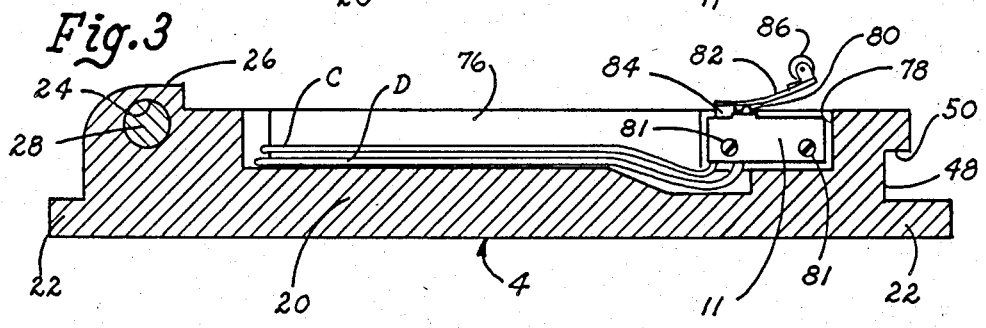
FIG. 3 is a view taken along the line 3—3 of FIG. 2 showing the wiring to the on-off microswitch.
Figure 4:
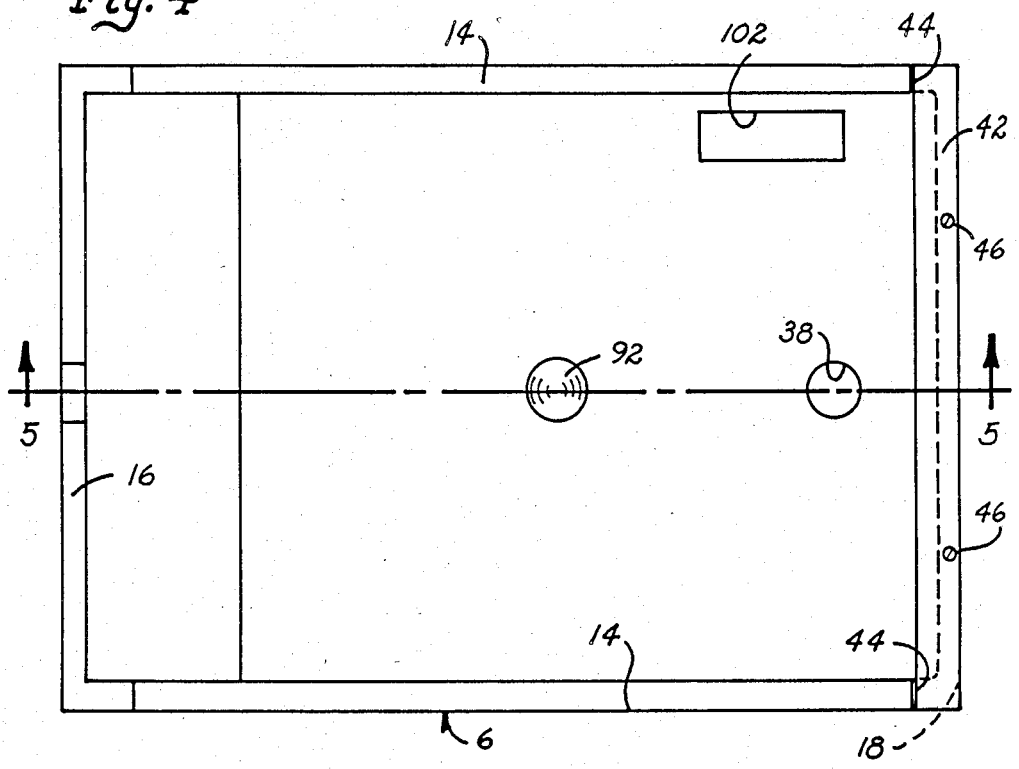
FIG. 4 is a view taken along the line 4—4 of FIG. 1 with the base member removed showing the interior of the actuator foot plate cover.
Figure 5:
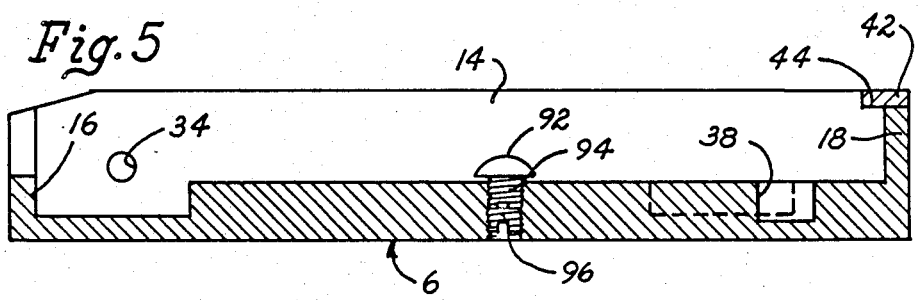
FIG. 5 is a view taken along the line 5—5 of FIG. 4 showing the end holding flange and adjustable mating actuator for contacting the circular actuating plate.

The foot pedal device 2 of FIG. 1 for varying resistance in an electrical circuit is formed of four main parts: (1) a base member 4; (2) an acutator foot plate cover 6 pivotally mounted at one end to base member 4 and having a foot engaging surface 8; (3) an array 10 of circular members located between said base member 4 and cover 6; and (4) and on-off microswitch 11. Base member 4 is formed having a rectangular upwardly extending body 20 with a flange 22 extending outwardly from around its bottom edge. As seen in FIG. 1, the actuator foot plate cover 6 is pivoted to base member 4 at one end by a pivotal connection 12 on each side thereof. The foot engaging surface 8 has downwardly extending sides 14 and downwardly extending ends 16 and 18 which fit over the rectangular upwardly extending body 20.

Each pivotal connection 12 comprises a bore 24 placed in the side of base member 4 adjacent one end, said end of base member 4 having a raised projection 26 extending over each bore 24. Each bore 24 has a cylindrical member 28 mounted therein. A spring 30 is positioned between the end of the cylindrical member 28 and the bottom of the bore 24 and a smaller cylindrical portion 32 is positioned on the other end of cylindrical member 28 for projecting out of the sides of the base member 4. The foot plate cover 6 has a cylindrical opening 34 on each side 14 to receive each smaller cylindrical portion 32. When the actuator foot plate cover 6 is pivotally mounted to the base member 4, each spring 30 is biasing the smaller cylindrical portion 32 of the cylindrical member 28 into its cooperating cylindrical opening 34 in mating sides 14.

The ends of the actuator foot plate cover 6 and base member 4 located away from the pivotal connection 12 are biased apart by a spring 36 with one end positioned in a cylindrical hole 38 placed on the inside of foot engaging surface 8 of actuator foot plate cover 6 and a cylindrical hole 40 placed in the mating upper surface of the rectangular upwardly extending body 20 of base member 4. A stop mechanism is positioned between actuator foot plate cover 6 and base member 4 to limit the distance which the spring 36 can move the two elements apart, thus limiting the upward angular position between the cover 6 and base member 4. The stop mechanism comprises a strip 42 which is fixedly postioned to the free end of downwardly extending end 18 of the actuator foot plate cover 6, said end 18 being shortened to receive the strip 42 with the ends positioned in notches 44 formed in the cooperating sides 14. While the strip 42 is shown being held to the end 18 by bolts 46, other means can be used.

A recess 48 is formed along the end of the base member 4, above the flange 22, away from the end having the raised projection 26, forming a stop surface 50. When the actuator foot plate cover 6 and base member 4 are assembled, the projecting strip 42 is placed in recess 48 and then the other ends are pivotally connected together, as described above. It can be seen that as the spring 40 biases the actuator foot plate cover 6 and base member 4 apart, the strip 42 will be biased against the stop surface 50, limiting the upward movement.

Figure 6:
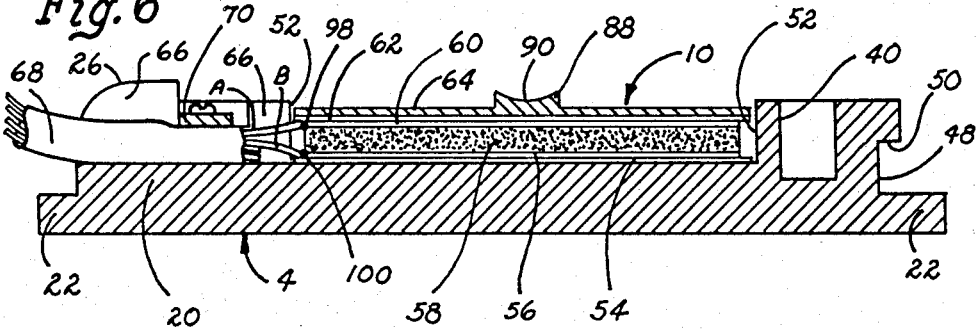
FIG. 6 is a view taken along the line 6—6 of FIG. 2 showing the compressible element, cooperating electrodes, and circular actuating plate.

As mentioned hereinbefore, an array 10 of circular members is positioned between the base member 4 and actuator foot plate cover 6. A large cylindrical recess 52 is positioned in the upper surface of the rectangular upwardly extending body 20 of base member 4 to receive the array 10 of circular members. This array 10 provides the electrical part of the device for varying the resistance in an electrical circuit and it is comprised of a first insulation disc 54; a first electrode disc 56; a compressible element 58 having electrically conductive particles dispersed throughout; a second electrode disc 60; a second insulation disc 62; and a circular actuating plate 64 (see FIG. 6). The depth of the large cylindrical recess 52 is made to accommodate the array 10 which will be hereinafter described.

A cutout passageway 66 is formed in the body 20 of base member 4 between the end of the body having the pivotal connections 12 and the cylindrical recess 52, said passageway 66 extending to a depth that matches the depth of the cylindrical recess 52. A conduit 68 has a free end positioned in the passageway 66 with its end held therein by a clamping bar 70 which is bolted at each end in recess 72 and recess 74 to squeeze the end of the conduit 68 to hold it in place.

The conduit 68 is shown having four wires A, B, C and D extending therethrough. An elongated passageway 76 connects cutout passageway 66 to a cutout section 78 at the side of the upwardly extending body 20 of the base member 4 adjacent the recess 48. An on-off microswitch 11 is positioned in the cutout section 78 with an actuating button 80 extending upwardly therefrom. While the microswitch 11 is shown fixedly moutned by screws 81, other fixing means can be used. Microswitch 11 has a switching action wherein the switch is normally open, placing it in a non-conducting position, when the actuating button 80 is biased outwardly.

The microswitch 11 has an actuator spring arm 82 affixed at one end between the microswitch 11 and the mating side of the cutout section 78 of the base member 4 by an arm 84. This actuating switch arm 82 extends just over the actuating button 80, while curving upwardly a short distance to its free end which contains a contacting roller 86 for a purpose to be hereinafter described. Wires C and D frm conduit 68 extend from the end of the conduit 68 in cutout passageway 66 through elongated passageway 76 to the microswitch 11 in cutout section 78. A glue, or wax, can be used to keep the wires C and D in the passageway 76. These two wires C and D are connected to the terminals of the microswitch 11. The other ends of the wires B and C extend to a control box (not shown), permitting the microswitch 11 to have an on-off control over the output of the control box to an electrical device which it is actuating, such as a motor.

The array 10 has the electrode disc 56 made slightly smaller then the insulation disc 54 and it is fixed in position to maintain it coaxial with the insulation disc 54. In a construction made, the insulation disc 54 and electrode disc 56 were made of copper-faced printed circuit material which is conductive on one side and non-conductive on the other, thereby having the two discs fixed together. This same arrangement follows for second electrode disc 60 and second insulation disc 62. It can be seen that the electrode discs 56 and 60 cannot be permitted to contact the inner surface of the cylindrical recess 52 so that there could be a possibility of a short circuit if the base member were formed of a metal. Further, to prevent this type of malfunction, the interior of the recess can be coated with a non-conductive material to further prevent a short circuit.

Wires A and B from conduit 68 extend through cutout passageway 66 to the large circular recess 52. Wire A is connected to the edge of the second electrode disc 60 at 98 and wire B is connected to the edge of the first electrode disc 56 at 100. The other ends of the wires B and C extend to a control box (not shown) and connect the electrode discs 56 and 60 and connecting compressible element 58 into the control box to variably control the output as a variable resistor.

The compressible element 58 can be formed of electrically insulating compressible elastomeric material which has electrically conductive particles dispersed therethrough which are operable to move into and out of an electrically conductive relationship in response to changes in the state of compression of the material. Materials of this nature are well known in the art and specifically disclosed in some of the patents referred to above. It can be seen that as the elastomeric material containing the particles is compressed, the resistance is decreased, and as the compression is removed, the material returns by itself to its original state, and the resistance is increased.

The circular actuating plate 64 comprises a stiff member which will place an even compressive force across the remainder of the array 10 as it is actuated. The circular actuating plate 64 has a raised center portion 88 having a socket 90 shaped as a portion of a spherical surface. This spherical socket 90 is formed to receive a head 92 of a screw member 94 threadably mounted in the top of the actuator foot plate cover 6. Head 92 is spherically shaped to mate with spherical socket 90 so that as the foot plate cover 6 is moved downwardly toward base plate member 4 through an angular movement, a force is placed on the circular actuating plate 64 to move it axially within the cylindrical recess 52.

Screw member 94 can be rotated to vary the extension of head 92 from the top inner surface of the foot plate cover 6. A second locking screw member 96 is located against the end of the screw member 94 to lock it in place when it has been accurately set. This permits the head 92 to be placed in a desired position with relation to spherical socket 90 so that the foot pedal device is originally positioned at the desired resistance. Circular shims can be placed under insulation disc 54 to help in positioning of the circular actuating plate 64, if necessary. It is noted that raised projection 26 was placed at the pivotal end of the foot pedal device 2 so that the pivot point would be approximately on a horizontal line with the head 92. This places the least angular component of force between the spherically shaped head 92 and spherical socket 90.

To achieve desired actuation of the microswitch 11, the top of the actuator foot plate cover 6 has a rectangular recess 102 placed therein for alignment with the microswitch 11. When the foot pedal device 2 is assembled, the actuator spring arm 82 and roller 86 extend into the recess 102 and the roller 86 is spaced from the bottom of the recess 102 so that when the head 92 moves the socket 90 and circular actuating plate 64 to compress element 58, the microswitch has been placed in an "on" position. To vary the time when the microswitch is turned "on" or "off", the spring arm 82 can be bent or the depth of the recess 102 can be changed.

As an operator's foot presses on the foot engaging surface 8 of the actuator foot plate cover 6, it moves downwardly towards the base member 4 about the pivotal connections 12. This action moves the spherically shaped head 92 to press against spherical socket 90 to move the circular actuating plate 64 downwardly within the cylindrical recess 52, and moves the bottom of the rectangular recess 102 to press against roller 86 to move the spring arm 82 downwardly and move the actuating button 80 therewith to close the microswitch 11, placing it in an "on" position, positioned for conducting. As the microswitch 11 is placed in an "on" position, permitting the current to flow between wires C and D, current will now flow from the control box and back thereinto where it will then flow through wires A and B and compressible element 58.

Now, the action of circular actuating plate 64 downwardly compressing the compressible element 58, varies the resistance thereof and varies current flow through wire B back into the control box where it is directed to the electrical device being operated, such as an electric motor. This will vary the speed of the motor, increasing it as the actuator foot plate cover 6 moves downwardly, decreasing the resistance of the compressible element 58. As the operator's foot releases the pressure on the foot engaging surface 8, the spring 36 moves the actuator foot plate cover 6 upwardly to its "at rest" position and the compressible element 58 assumes its "at rest" position with no pressure on circular actuating plate 64.

We claim:

1. A foot pedal device for varying resistance in an electrical circuit comprising a base plate; an actuator foot plate; means pivotally mounting one end of said foot plate to one end of said base plate; means limiting the distance the other ends of said foot plate and base plate can open; spring means biasing said other ends to their open position; a circular recess in said base plate faces said actuator foot plate; an array of circular members positioned in said circular recess; said array comprising a first insulating disc, a first electrode disc, a compressible resistance disc, a second electrode disc, a second insulating disc, and a circular actuating plate; said circular actuating plate having an upwardly facing spherical seat at the center thereof; said actuator foot plate having a downwardly extending spherical surface for engaging said spherical seat to compress said compressible resistance disc to vary the resistance thereof between said first and second electrode discs; electrical conducting means connected to each electrode disc for forming part of an electrical circuit.

2. A foot pedal device as set forth in claim 1 wherein a microswitch is mounted on said base plate; second electrical conducting means connected to said microswitch for forming part of an electrical circuit.

3. A foot pedal device as set forth in claim 1 including means for variably positioning said downwardly extending spherical surface with respect to said actuator foot plate to control the engagement of the spherical surface with the upwardly facing spherical seat.

4. A foot pedal device as set forth in claim 3 including an upwardly extending actuator on said microswitch to place said microswitch in an "on" or "off" position, a recess placed in said actuator foot plate to receive said upwardly extending actuator, said recess having a predetermined depth to turn said microswitch "on" by a downward movement of the actuator foot plate to a predetermined angular position with said base plate.

5. A foot pedal device as set forth in claim 2 wherein said other end of said base plate has an elongated recess across its width forming an elongated projecting limiting flange, said other end of said foot plate having a downwardly extending flange having a lower end extending to said elongated recess, a limiting flange strip fixedly positioned to the lower end of said downwardly extending flange projecting into said recess, movement of said foot plate upwardly being limited by contact of said flange strip with said elongated projecting limiting flange to properly position said foot plate for actuation of said circular actuating plate and microswitch.

* * * * *